US008230975B2

(12) United States Patent
Lukas et al.

(10) Patent No.: US 8,230,975 B2
(45) Date of Patent: Jul. 31, 2012

(54) DEVICE AND METHOD FOR SUPPLYING LUBRICATING OIL

(75) Inventors: Franz Lukas, Ingolstadt (DE); Volker Verhees, Ingolstadt (DE); Dieter Böhm, Böhmfeld (DE)

(73) Assignee: Audi AG, Ingolstadt (DE)

( * ) Notice: Subject to any disclaimer, the term of this patent is extended or adjusted under 35 U.S.C. 154(b) by 867 days.

(21) Appl. No.: 11/884,356

(22) PCT Filed: Feb. 11, 2006

(86) PCT No.: PCT/EP2006/001263

§ 371 (c)(1),
(2), (4) Date: Aug. 15, 2007

(87) PCT Pub. No.: WO2006/087151

PCT Pub. Date: Aug. 24, 2006

(65) Prior Publication Data

US 2008/0257648 A1 Oct. 23, 2008

(30) Foreign Application Priority Data

Feb. 15, 2005 (DE) ..... 10 2005 006 703

(51) Int. Cl.
*F01M 1/02* (2006.01)
*F04C 14/22* (2006.01)
*F04B 53/12* (2006.01)

(52) U.S. Cl. ..... 184/26; 418/5; 418/24; 417/545

(58) Field of Classification Search ..... 184/26; 418/24, 26, 27, 30, 31, 5; 417/213, 545
See application file for complete search history.

(56) References Cited

U.S. PATENT DOCUMENTS

| | | | | |
|---|---|---|---|---|
| 3,656,869 | A * | 4/1972 | Leonard | 417/220 |
| 4,325,215 | A | 4/1982 | Yamamoto | |
| 4,505,653 | A * | 3/1985 | Roberts | 418/23 |
| 5,042,616 | A * | 8/1991 | McHugh | 184/6.11 |
| 5,690,479 | A | 11/1997 | Lehmann et al. | |
| 6,402,487 | B1 * | 6/2002 | Clements et al. | 418/26 |
| 2003/0031567 | A1 * | 2/2003 | Hunter et al. | 417/220 |

FOREIGN PATENT DOCUMENTS

| | | |
|---|---|---|
| DE | 3333647 | 5/1984 |
| DE | 9422150 U | 8/1998 |
| EP | 1225337 | 7/2002 |

* cited by examiner

*Primary Examiner* — Michael Mansen
*Assistant Examiner* — Robert Reese
(74) *Attorney, Agent, or Firm* — Novak Druce + Quigg LLP

(57) ABSTRACT

The invention relates to a device for feeding lubricating oil to an internal combustion engine. This device comprises a lubricating oil pump and an oil pressure regulating apparatus. The lubricating oil pump is designed as a reciprocating piston valve pump and the oil pressure regulating apparatus is designed as a multistage oil pressure regulating apparatus.

5 Claims, 4 Drawing Sheets

DEVICE AND METHOD FOR SUPPLYING LUBRICATING OIL

CROSS-REFERENCE TO RELATED APPLICATIONS

This application claims priority from German Application No. 102005006703.4 filed Feb. 15, 2005, hereby incorporated by reference in its entirety.

The invention relates to a device for supplying an internal combustion engine of a motor vehicle with lubricating oil, with a lubricating oil pump and an oil pressure regulating apparatus.

BACKGROUND OF THE INVENTION

In lubricating oil pumps of an internal combustion engine of a motor vehicle the delivery volume is customarily designed for the most unfavorable case of hot idling. This design takes the fact into account that given high oil temperature and a correspondingly low oil viscosity as well as a low speed of the internal combustion engine the lubricating oil supply must nevertheless be ensured. This has the result that in all other operating states the lubricating oil pump delivers too large an amount of supplied lubricating oil, that is, it is "designed too large". Vane cell pumps with an adjustable delivery amount offer the possibility of carrying out a variable regulation of the volume current. Conventional vane cell pumps can be combined with a multistage pressure regulation so that a lubricating oil supply device is present whose oil pressure can be adjusted and that can be roughly adapted to different operating states.

The invention has the problem of creating a robust and economical device for supplying an internal combustion engine with lubricating oil that allows a good adaptation to the different operating states of the internal combustion engine.

SUMMARY OF THE INVENTION

This problem is solved in accordance with the invention in a device of the initially cited type in that the lubricating oil pump is designed as a reciprocating piston valve pump and the oil pressure regulating apparatus is designed as a multistage oil pressure regulating apparatus. Since the power consumption of the lubricating oil pump for the internal combustion engine is substantially a function of the hydraulic power, namely the product of oil delivery volume current and pressure elevation, in addition to the internal friction, the solution in accordance with the invention allows an optimal adaptation of the power consumption of the lubricating oil pump to the requirement of the internal combustion engine. The concept "internal combustion engine" denotes in the context of this application the internal combustion engine itself and furthermore any accessory units. The design of the lubricating oil pump as a reciprocating piston valve pump permits a coordination of the transport volume as a function of the particular operating state of the internal combustion engine, optionally taking other parameters into account. Furthermore, the variability of the oil pressure on account of the multistage oil pressure regulating apparatus is also present so that the product of delivery volume and pressure elevation that determines the hydraulic power of the lubricating oil pump can always be influenced in such a manner that the smallest possible power consumption is present as a function of the operating state of the internal combustion engine. The reciprocating piston valve pump that can be adjusted in the delivery amount has the advantage over a conventional vane cell pump that the vanes of the internal rotor that are designed as reciprocating piston valves do not run with a relative high speed to a stroke ring, thus producing critical lubricating states but rather the reciprocating piston valves are movably arranged with their outer ends in grooves of a control ring, which control ring rotates in a stroke ring and is therefore hydrodynamically supported. The cited critical lubricating states and a correspondingly high wear therefore do not occur in the reciprocating piston valve pump used in accordance with the invention. The subject matter of the invention therefore makes a high degree of operational safety possible.

A further development of the invention provides that the coupling between the oil pressure regulating apparatus and a delivery volume adjustment apparatus of the reciprocating piston valve pump is designed to be mechanical or hydraulic. The oil pressure regulating apparatus acts on the delivery volume adjustment apparatus of the reciprocating piston valve pump in order to influence the delivered amount of lubricating oil and therewith the oil pressure. To this end the oil pressure regulating apparatus comprises a control piston or spool that performs shifting movements as a function of the oil pressure. These shifting movements can be mechanically transferred to the delivery volume adjustment apparatus of the reciprocating piston valve pump in order to adjust the transport volume. Alternatively, it is possible that the movement of the control piston results in a shifting of a control edge, as a result of which a corresponding hydraulic pressure is supplied to a hydraulic pilot control of the reciprocating piston valve pump, as a result of which a corresponding amount of lubricating oil is delivered by the pump.

The oil pressure regulating apparatus is preferably designed as a two-stage oil pressure regulating apparatus. The required oil pressure is determined by an overriding control- or regulating apparatus and influences the oil pressure regulating apparatus in such a manner that either the lower or the higher oil pressure is available.

It is advantageous if the oil pressure regulating apparatus comprises a control piston with several, in particular two active surfaces for a loading with control pressure. If one of the active surfaces is loaded by the control pressure, this brings about a corresponding position of the control piston that results in a corresponding lubricating oil pressure. If another active surface in the surface area or additionally at least one further active surface is loaded by the control pressure, the control piston shifts into a new position with the consequence that now another oil pressure is brought about.

The control piston is preferably loaded by the control pressure and in the opposite direction by a pressure spring. Therefore, the control pressure operates counter to the force of the pressure spring, during which the control pressure brings about a corresponding position of the control piston as a function of its magnitude and the magnitude of the active surface of the control piston. The control ring of the pump is shifted in such a manner by the shifting of the control piston that a corresponding delivery volume is adjusted that for its part results in the desired oil pressure in the engine.

A multiple-way valve is preferably provided for cutting in or out the loading of the active surfaces of the control piston with the control pressure or with at least one control pressure. If a two-stage oil pressure regulating apparatus is present, a two-way valve can be used and in particular a 3/2-way pilot valve can be used.

The invention also relates to a method for supplying an internal combustion engine of a motor vehicle with lubricating oil, with a lubricating oil pump and an oil pressure regulating apparatus, especially for operating a device for the supplying with lubricating oil of the previously described type. A reciprocating piston valve pump is used as lubricating oil pump and a multistage oil pressure regulating apparatus is used as oil pressure regulating apparatus.

It is furthermore advantageous as concerns the method if the delivery volume of the lubricating oil delivered by the reciprocating piston valve pump and/or the lubricating oil pressure of the lubricating oil delivered by the reciprocating piston valve pump is/are adjusted, especially controlled or regulated, in such a manner that the power consumption of the lubricating oil pump is as low as possible, especially minimized, taking into consideration the operating state of the internal combustion engine. This adaptation of the power consumption takes place by adjusting the delivery volume of the lubricating oil while simultaneously adjusting the lubricating oil pressure.

The drawings illustrate the invention using an exemplary embodiment.

DETAILED DESCRIPTION OF AN EMBODIMENT OF THE INVENTION

Figure 1:
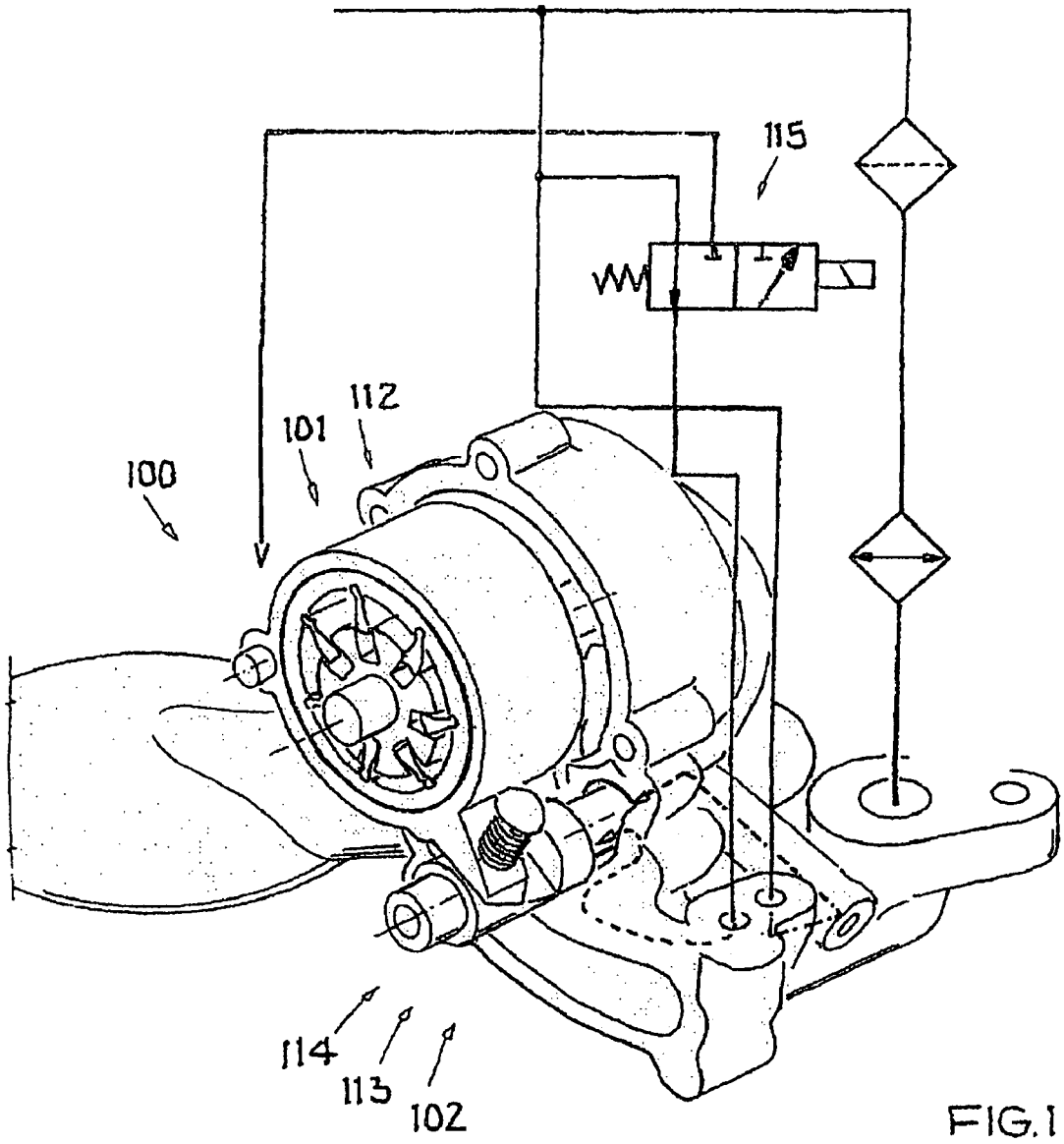
FIG. 1 shows a perspective view of a device for supplying an internal combustion engine with lubricating oil in a partially open state, a partially exploded view and with a connection installation.

FIG. 1 shows a device 100 for supplying an internal combustion engine with lubricating oil. Device 100 comprises a variable displacement type vane pump 101 and an oil pressure regulating apparatus 102 as well as a valve 115, which latter is described in detail with reference made in FIG. 3.

Figure 2:
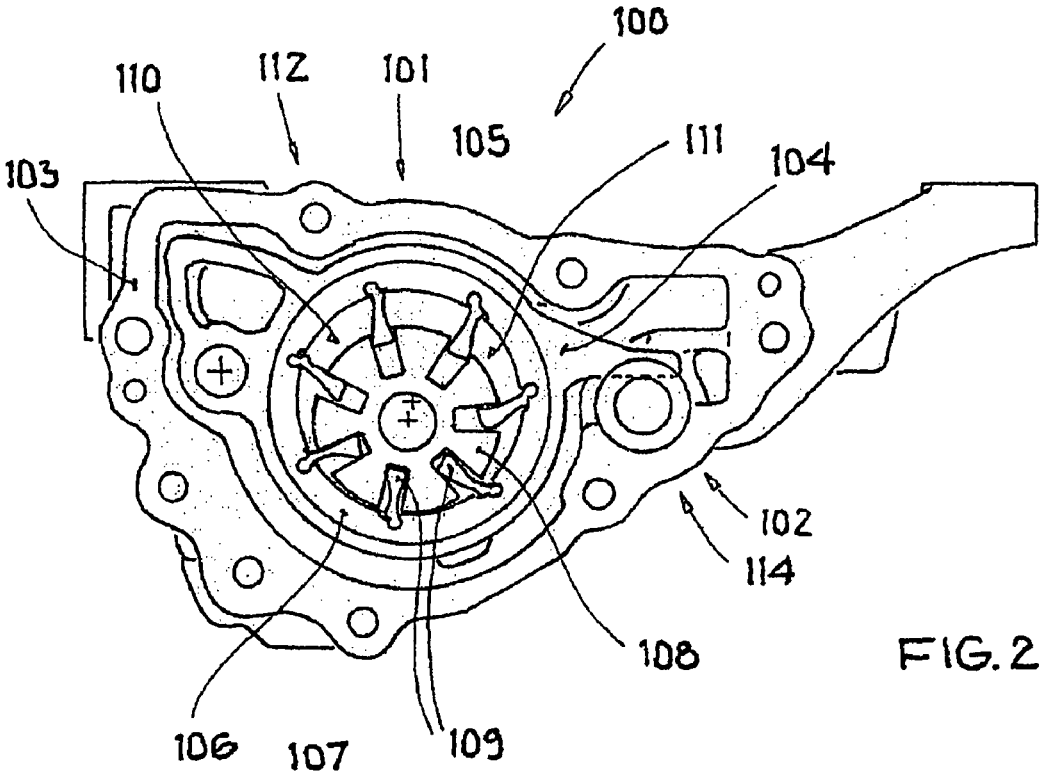
FIG. 2 shows a vertical cross section through the device of FIG. 1.

According to FIG. 2, device 100 comprises a common housing 103 for lubricating oil pump 101 and oil pressure regulating apparatus 102 in which housing a control element 104 is mounted that forms a control ring 105. Outer rotor 106 is rotatably mounted in control ring 105 and forms a stroke ring 107. Inner rotor 108 is located inside stroke ring 107 and supports radially movable reciprocating piston valves 109 on one end whereas the other ends of reciprocating piston valves 109 are guided in grooves of stroke ring 107. Pressure chambers 110 and suction chambers 111 are formed between each two adjacent reciprocating piston valves 109 as well as the associated surfaces of outer rotor 106 and inner rotor 108. The volume of these pressure chambers 110 and suction chambers 111 can be continuously varied by shifting the eccentric position, visible in FIG. 2, of outer rotor 6 to inner rotor 8 into a concentric position of these two components in such a manner that in the concentric position no delivery of the lubricating oil to be delivered takes place on account of the steady volumes of pressure chambers 110 and of section chambers 111 and, depending on the degree of the eccentricity, a corresponding volume of lubricating oil is delivered.

Not only lubricating oil pump 101 but also oil pressure regulating apparatus 102 are integrated into housing 103. This can be gathered from FIGS. 1 and 2.

Figure 3:
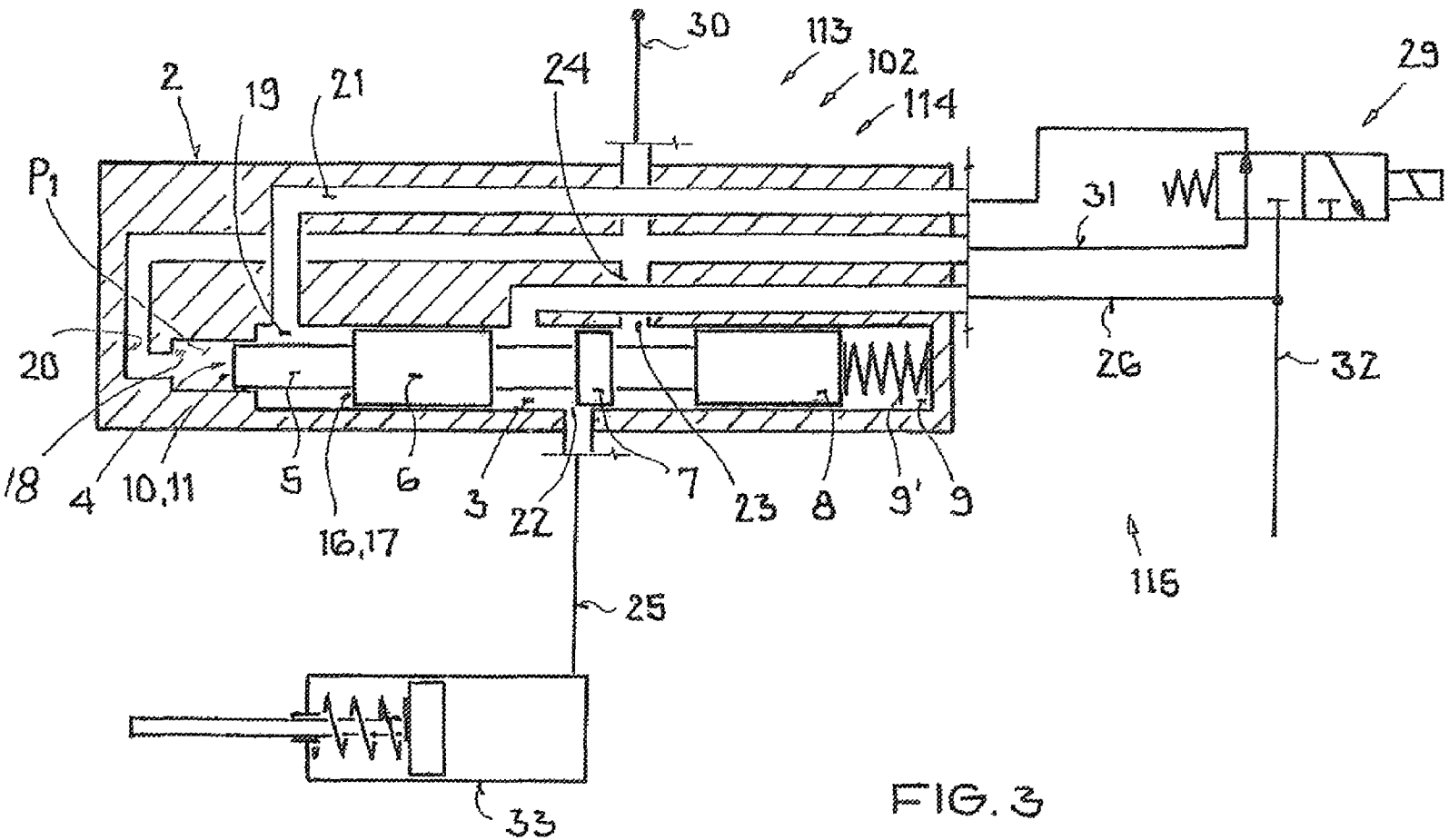
FIG. 3 shows a longitudinal section through an oil pressure regulating apparatus of the device of FIG. 1.

FIG. 3 illustrates oil pressure regulating apparatus 102 in a schematic view. It comprises a cylindrical chamber 3 inside material block 2, in which spool 4 is guided in a longitudinally movable manner. Chamber 3 comprises a first variable chamber 18 and a second variable chamber 19 connected to it in a longitudinal extension. Chambers 18, 19 are concentric to one another. Spool 4 comprises a section 5 and a second section 6. The first section 5 is guided in chamber 18 and the second section 6 in the second chamber 19. Second section 6 is followed by regulating element 7 that comprises head surface 8 that faces away from second section 6 and is loaded by return spring 9 designed as a pressure spring 9'. Control spool 4, that assumes a regulating task, is guided in chamber 3 in a longitudinally shiftable manner. The diameters of spool sections 5, 6 have different sizes, that is, first section 5 has a smaller diameter than second section 6. Consequently, the diameter of first chamber 18 is smaller than that of second chamber 19. First section 5 has a first front surface 10 that faces away from second section 6. First front surface 10 forms a first bearing surface 11 (first active surface 11') of a pressure surface of control spool 4. Second spool section 6 comprises a differential surface 16 that forms a second bearing surface 17 of control spool 4. Second bearing surface 17 forms a second active surface 17'. Second bearing surface 17 results from the difference between first front surface 10 and the cross-sectional surface of the second spool section 6.

A first pressure connection or passageway 20 empties into first chamber 18. A second pressure connection or passageway 21 empties radially into the second chamber 19. A third pressure connection or passageway 24 runs into a part of chamber 3 designed as regulating chamber 23 in which regulating element 7 is located. System pressure connection or passageway 30 conducting lubricating oil is connected to a system regulating connection 31 and to the first passageway 20 as well as the third passageway 24. System pressure connection 30 runs to the lubricating oil pressure discharge side of lubricating oil pump 101 that is not shown in FIG. 3 but is apparent from FIGS. 1, 2. System pressure connection 30 therefore [stands under] is at pump pressure. System regulating connection 31 also runs like the first pressure connection 21 to a 3/2-way valve 29. A discharge line 32 is connected to 3/2-way valve 29 which line empties into an oil catch container, e.g., an oil pan (not shown). Furthermore, a drain line 26 is connected to discharge line 32, which drain line empties into regulating chamber 23 in the area of regulating element 7, namely in an area between regulating element 7 and the second spool section 6. A regulating line 25 is connected to regulating chamber 23 and runs to adjustment cylinder 33 of lubricating oil pump 101 not shown in FIG. 2.

Lubricating oil pump 101 is, as is apparent from the previous description, designed as a variable displacement type valve pump 112.

The following operation results: At first, the function of two-stage oil pressure regulating apparatus 14 will be discussed. In a position of the 3/2-way valve 29 for a lower system pressure level of the lubricating oil the second pressure connection 21 and the system regulating connection 31 are connected to one another. In the first pressure connection 20 and the system regulating connection 31 the system pressure brought about via system pressure connection 30 and generated by reciprocating piston valve pump 112 is present as first hydraulic pressure $P_1$ and loads the first bearing surface 11 of the first spool section 5. This first hydraulic pressure $P_1$ is also switched to the second pressure connection 21 via 3/2-way valve 29 and results in a second hydraulic pressure $P_2$ that is just as great as $P_1$. Second bearing surface 17 of second spool section 6 is loaded with hydraulic pressure $P_2$. Altogether, this results in an active pressure $P_W$ that acts on spool 4 and brings about its longitudinal shifting counter to the force of return spring 9 until an equilibrium of force has been adjusted between active pressure $P_W$ and the force of return spring 9. As a result of the longitudinal shifting a regulating orifice 22 is closed to a greater or lesser extent in regulating chamber 23 by regulating element 7 so that the system pressure is present only in a corresponding magnitude via a regulating line 25 on adjustment cylinder 33 of reciprocating piston valve pump 112. This brings about a change of the amount of lubricating oil delivered by reciprocating piston valve pump 112. The lubricating oil pressure is adjusted to a selectable amount by means of the cited control- or regulating apparatus and the transported amount of the reciprocating piston valve pump is adjusted in such a manner thereby that a suitable supplying of the internal combustion engine is present at a low power consumption of the reciprocating piston valve pump.

If the internal combustion engine of the motor vehicle requires a certain amount of lubricating oil at a certain pressure on account of a change of the operating point, the absorption behavior of the motor changes in the direction of a greater oil pressure and thus the consequence is a reduction of pressure in system pressure connection 30.

As a result, a reduced first hydraulic pressure $P_1$ is also present on the first bearing surface 11 via first pressure connection 20 and a reduced second hydraulic pressure $P_2$ is present on the second bearing surface 17 via second pressure connection 21. The resulting active pressure $P_W$ is therefore less, so that now the force of return spring 9 prevails over active pressure $P_{1w}$ and a longitudinal moving of spool 4 in the direction of return spring 9 is brought about, as a result of which regulating element 7 enlarges regulating orifice 22 As a consequence thereof, the pressure loading of adjustment cylinder 33 of reciprocating piston valve pump 112 is increased via regulating line 25, so that this pump compensates its delivery to the increased requirement. The pressure drop is compensated by this increased delivery and the system pressure regulated to the desired level.

If a higher pressure level of the system pressure becomes necessary given a totally higher system load, this can be adjusted by switching 3/2-way valve 29. When 3/2-way valve 29 is switched, the hydraulic pressure $P_2$ present on first bearing surface 17 and prevailing in second chamber 19 is connected to discharge line 32. At the same time system regulating connection 31 is closed. Consequently, the first hydraulic pressure $P_1$ is present on first bearing surface 11 and on the other hand the second bearing surface 17 is without pressure. As a consequence, the first hydraulic pressure $P_1$ opposes the force of return spring 9 only with a lesser force so that a longitudinal shifting of control spool 4 takes place in the pressure direction of return spring 9. As a result of this longitudinal shifting, regulating element 7 will release regulating orifice 22 further. The system pressure now loads regulating line 25 via released regulating chamber 23 and regulating orifice 22 so that a higher system pressure is adjusted via adjusting cylinder 33 of reciprocating piston valve group 112. Alternatively, it is also possible that the first bearing surface 11 is without pressure and only the second bearing surface 17 is loaded with hydraulic pressure.

Figure 4:
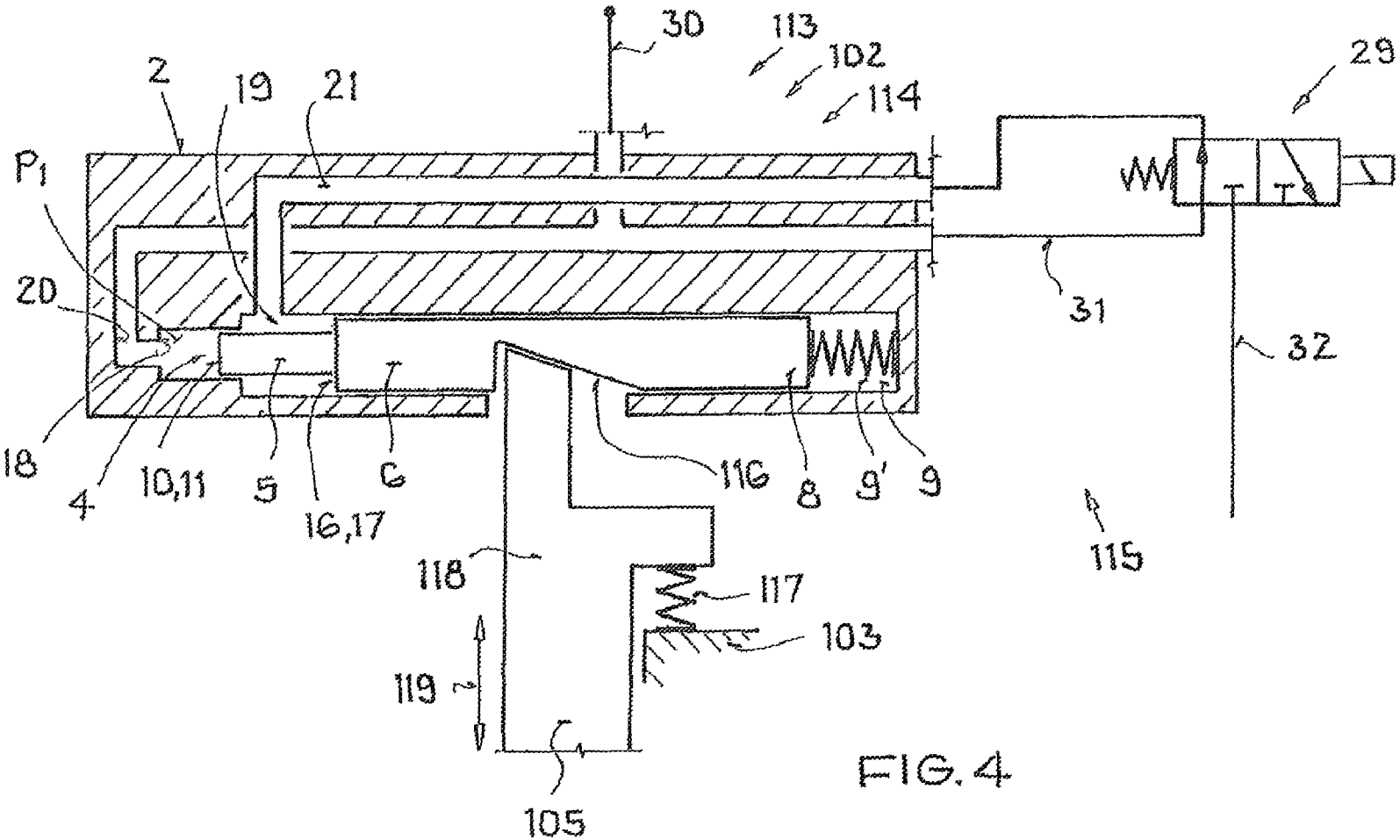
FIG. 4 shows a longitudinal section through another exemplary embodiment of an oil pressure regulating apparatus of the device of FIG. 1.

The exemplary embodiment of FIG. 4 corresponds substantially to the exemplary embodiment of FIG. 3. However, instead of a hydraulic coupling between oil pressure regulating apparatus 114 and a transport volume adjustment apparatus of reciprocating piston valve pump 112 a mechanical coupling is provided. To this extent regulating line 25, drain line 26, adjustment cylinder 33 and the third pressure connection 24 are eliminated in FIG. 4.

The differences between the exemplary embodiment of FIG. 4 from the exemplary embodiment of FIG. 3 are presented in the following. Regarding the design of FIG. 4 the comments regarding FIG. 3 are referred to as regards the coinciding features.

Control spool 4 is provided according to FIG. 4 with an oblique surface 116 standing at an angle to its direction of longitudinal movement against which surface a follower member 118 of control ring 105 of variable displacement valve pump 112 rests by means of spring 117. Follower member 118 is mounted in such a manner that it can shift according to double arrow 119. If spool 4 shifts, follower member 119 and therewith control ring 105 are shifted in a corresponding manner due to oblique surface 116 with the consequence that as a result the relative position of outer rotor 6 to inner rotor 8 of reciprocating piston valve pump 112 is changed. As explained above, these two components can continuously change their eccentric position into a concentric position. Therefore, control ring 105 brings about a corresponding adjustment of outer rotor 6 to inner rotor 8 as a function of the position of control piston 4, as a result of which the delivery amount of lubricating oil of reciprocating piston valve pump 112 is determined. It is preferable if a continuous possibility of adjusting the delivery amount is present.

An optimal adaptation of the power consumption of lubricating oil pump 101 to the requirements of the internal combustion engine can be achieved on account of the previously cited design of lubricating oil pump 101 as reciprocating piston valve pump 112 and of multistage oil pressure regulating apparatus 113.

LIST OF REFERENCE NUMERALS

2 material block
3 cylinder
4 control spool
5 first spool section
6 second spool section
7 regulating element
8 head surface
9 return spring
9' pressure spring
10 first front surface
11 first bearing surface
11' first active surface
16 differential surface
17 second bearing surface
17' second active surface
18 first variable chamber
19 second variable chamber
20 first pressure connection
21 second pressure connection
23 regulating chamber
24 third pressure connection
25 regulating line
26 drain line
29 3/2-way valve
30 system pressure connection
31 system regulating connection
32 discharge line
33 adjustment cylinder
100 device
101 lubricating oil pump
102 oil pressure regulating apparatus
103 housing
104 control element
105 control ring

106 outer rotor
107 stroke ring
108 inner rotor
109 piston valve
110 pressure chamber
111 suction chamber
112 reciprocating piston valve pump
113 multistage oil pressure regulating apparatus
114 two-stage oil pressure regulating apparatus
115 connection installation
116 oblique surface
117 spring
118 follower member
119 double arrow

The invention claimed is:

1. An apparatus for supplying oil to an internal combustion engine, comprising:

a variable displacement type vane pump including biasing means for eccentrically displacing a vane carrying ring thereof relative to a rotor thereof to provide first and second flow rates; and a regulator including, a first passageway intercommunicable with a source fluid under pressure and means for displacing said vane carrying ring;

a second passageway intercommunicable with said displacing means and a drain;

a spool having a portion displaceable in a chamber along a line of travel between a first position obstructing said first passageway and nonobstructing said second passageway, and a second position obstructing said second passageway and nonobstructing said first passageway;

means for biasing said spool in a first direction along said line of travel to position said spool portion in said first position;

a third passageway intercommunicable with said fluid pressure source and a surface of said spool disposed at an angle to said line of travel, functional upon communication with said fluid pressure source to displace said spool portion in said second position; and a valve in said third passageway operable in a first position obstructing said third passageway and a second position nonobstructing said third passageway.

2. An apparatus according to claim 1 wherein said valve is operable responsive to predetermined load conditions of said engine.

3. An apparatus according to claim 1 wherein said pump and regulator are formed as an integral unit.

4. An apparatus for supplying oil to an internal combustion chamber, comprising:

a variable displacement type pump including biasing means for eccentrically displacing a vane carrying ring thereof relative to a rotor thereof to provide first and second flow rates; and a regulator including, a spool disposed in and displaceable along a line of travel, in a chamber, provided with a first surface disposed at an acute angle relative to said line of travel and a second surface disposed at an angle relative to said line of travel;

means disposed in said chamber for biasing said spool in a first direction along said line of travel;

a first passageway intercommunicable with a source of fluid under pressure and a portion of said chamber including said second surface of said spool, operable to displace said spool along said line of travel opposite to said first direction; and a second passageway intercommunicable with said chamber portion and a drain; and a valve in said second passageway operable in a first position obstructing said second passageway and a second position nonobstructing said second passageway;

a follower displaceable along a second line of travel intersecting said first mentioned line of travel including a first portion received within said regulator and engaging said first surface of said spool and a second portion operatively connected to said means for eccentrically displacing said vane carrying ring of said pump; and means for biasing said first portion of said follower into camming engagement with said first surface of said spool.

5. An apparatus according to claim 4 wherein said spool and follower are provided with engaging planar cam surfaces lying in a plane of said acute angle to said line of travel of said spool.

* * * * *